US012297648B2

(12) United States Patent
Larsson et al.

(10) Patent No.: US 12,297,648 B2
(45) Date of Patent: May 13, 2025

(54) SET OF PANELS WITH MECHANICAL POSITIONING MEANS

(71) Applicant: Välinge Innovation AB, Viken (SE)

(72) Inventors: Lucas Larsson, Höganäs (SE); Caroline Landgård, Lerberget (SE)

(73) Assignee: VÄLINGE INNOVATION AB, Viken (SE)

( * ) Notice: Subject to any disclaimer, the term of this patent is extended or adjusted under 35 U.S.C. 154(b) by 172 days.

(21) Appl. No.: 18/069,320

(22) Filed: Dec. 21, 2022

(65) Prior Publication Data

US 2023/0235571 A1 Jul. 27, 2023

(30) Foreign Application Priority Data

Jan. 21, 2022 (SE) ..... 2250053-2

(51) Int. Cl.
*E04F 15/02* (2006.01)

(52) U.S. Cl.
CPC ..... *E04F 15/02038* (2013.01); *E04F 2201/0146* (2013.01); *E04F 2201/023* (2013.01); *E04F 2201/042* (2013.01); *E04F 2201/044* (2013.01); *E04F 2201/0535* (2013.01); *E04F 2201/0547* (2013.01)

(58) Field of Classification Search
CPC ..... E04F 15/02038; E04F 2201/0416; E04F 2201/023; E04F 2201/042; E04F 2201/044; E04F 2201/0535; E04F 2201/054
USPC ..... 52/586.1
See application file for complete search history.

(56) References Cited

U.S. PATENT DOCUMENTS 7,721,503 B2 * 5/2010 Pervan ..... E04F 15/02 52/177
9,322,183 B2 * 4/2016 Pervan ..... E04F 15/02038
11,634,912 B2 * 4/2023 Devos ..... B32B 27/304 52/588.1
12,071,770 B2 * 8/2024 Devos ..... E04F 15/02038
2005/0210810 A1 * 9/2005 Pervan ..... E04F 15/02038 52/578

(Continued)

FOREIGN PATENT DOCUMENTS

WO 2020/234711 A1 11/2020

OTHER PUBLICATIONS

U.S. Appl. No. 18/635,607, Fredrik Boo, filed Apr. 15, 2024.

(Continued)

*Primary Examiner* — Paola Agudelo
(74) *Attorney, Agent, or Firm* — Boone IP Law

(57) ABSTRACT

A set of rectangular building panels have a frontside and a backside and a mechanical locking device at opposite first and second edge portion configured for plane locking of similar panels in an assembled position by means of displacement of a plane with a second edge portion of a second panel in an engagement direction towards a first edge portion of an adjacent first panel. The first edge portion includes a first locking element configured to cooperate for plane locking with a first locking groove at the second edge portion. The first edge portion has a first front edge portion adjacent the frontside of the first panel and a first sub edge portion between the first front edge portion and a flexible tongue in an insertion groove, the insertion groove being arranged between the backside of the first panel and the first sub edge portion.

18 Claims, 8 Drawing Sheets

(56) References Cited

U.S. PATENT DOCUMENTS

| | | | | |
|---|---|---|---|---|
| 2013/0097959 | A1* | 4/2013 | Michel | E04C 2/30 29/557 |
| 2018/0094441 | A1* | 4/2018 | Boo | E04F 15/02038 |
| 2018/0119429 | A1* | 5/2018 | Schulte | E04F 15/02038 |
| 2020/0224430 | A1* | 7/2020 | Ylikangas | E04F 15/04 |
| 2020/0270874 | A1* | 8/2020 | Dürnberger | E04F 15/02033 |
| 2021/0062517 | A1* | 3/2021 | Markovski | E04F 15/02038 |
| 2021/0087827 | A1* | 3/2021 | Ylikangas | B27G 13/14 |
| 2021/0254349 | A1* | 8/2021 | Schäfers | E04F 15/102 |
| 2022/0127850 | A1* | 4/2022 | Boo | E04C 2/00 |
| 2022/0243482 | A1* | 8/2022 | Landgård | E04F 13/0894 |
| 2022/0403664 | A1* | 12/2022 | Boo | E04F 15/105 |
| 2023/0175260 | A1* | 6/2023 | Boo | E04F 15/02038 52/578 |
| 2023/0175272 | A1* | 6/2023 | Cappelle | E04F 15/02033 52/588.1 |

OTHER PUBLICATIONS

U.S. Appl. No. 17/697,334, Fredrik Boo, filed Mar. 17, 2022.
U.S. Appl. No. 18/313,110, Darko Pervan, filed May 5, 2023.
U.S. Appl. No. 18/222,449, Christian Boo, filed Jul. 16, 2023.
U.S. Appl. No. 18/242,312, Roger Ylikangas, filed Sep. 5, 2023.
U.S. Appl. No. 18/370,443, Fredrik Boo, filed Sep. 20, 2023.
U.S. Appl. No. 18/370,454, Anders Nilsson, filed Sep. 20, 2023.
International Search Report and Written Opinion received for PCT Patent Application No. PCT/SE2022/051216, mailed on Feb. 8, 2023, 14 pages.
Office Action received for Swedish Patent Application No. 2250053. 2, mailed on Sep. 21, 2022, 9 pages.
U.S. Appl. No. 18/963,840, Anders Nilsson, Nov. 29, 2024.
U.S. Appl. No. 19/014,541, Fredrik Boo, Jan. 9, 2024.

* cited by examiner

SET OF PANELS WITH MECHANICAL POSITIONING MEANS

CROSS REFERENCE TO RELATED APPLICATIONS

The present application claims the benefit of Swedish Application No. SE 2250053-2, filed on Jan. 21, 2022. The entire contents of Swedish Application No. SE 2250053-2 are hereby incorporated herein by reference in their entirety.

TECHNICAL FIELD

Embodiments of the present invention relates to a set of rectangular building panels having a frontside and a backside, comprising a mechanical locking device at opposite first and second edge portion configured for plane locking of similar panels in an assembled position by means of displacement of a plane with a second edge portion of a second panel in an engagement direction towards a first edge portion of an adjacent first panel. The first edge portion comprises a first locking element configured to cooperate for plane locking with a first locking groove at the second edge portion. The first edge portion has a first front edge portion adjacent the frontside of the first panel and a first sub edge portion between the first front edge portion and a flexible tongue in an insertion groove, the insertion groove being arranged between the backside of the first panel and the first sub edge portion. The first front edge portion provides a plane perpendicular to a plane of the frontside and the sub edge portion is arranged as a tongue between the first front edge portion and the insertion groove. The second edge portion has a second front edge portion configured to be in contact with the first front edge portion in the assembled state of the panels. The second edge portion further has a second sub edge portion adapted to be positioned opposite the first sub edge portion in the assembled state. The second edge portion has a protrusion arranged between the second sub edge portion and the backside of the panel.

BACKGROUND

Building panels, such as floor panels, may typically comprise a mechanical locking system for assembling with similar panels in a locked position. The mechanical locking system may lock adjacent panels in a horizontal and/or vertical direction.

Known floor panels comprise a first and second opposite edge portions, such as short edges. Such mechanical locking systems configured to lock the adjacent edge portions horizontally and vertically by means of a vertical displacement of the second edge portion of a panel while an adjacent third or fourth edge is assembled with a further adjacent panel by means of a folding displacement. The vertical locking of the first and second edge portion may be achieved by various principles.

It has been found that some types of assembling may inflict damage to some parts of at least one of the panels. Accordingly, there is room for improvement in the technical field.

SUMMARY

It is therefore an object of the present invention to provide an improved locking system for building panels.

According to a first aspect of the present disclosure a set of rectangular building panels having a frontside and a backside is provided. The set comprises a mechanical locking device at opposite first and second edge portion configured for plane locking of similar panels in an assembled position by means of displacement of a plane with a second edge portion of a second panel in an engagement direction towards a first edge portion of an adjacent first panel. The first edge portion comprises a first locking element configured to cooperate for plane locking with a first locking groove at the second edge portion.

The building panels could be, for instance, floor panels. For floor panels, the term "plane locking" would thus be "horizontal locking".

The first edge portion has a first front edge portion adjacent the frontside of the first panel and a first sub edge portion between the first front edge portion and a flexible tongue in an insertion groove, the insertion groove being arranged between the backside of the first panel and the first sub edge portion. The first front edge portion provides a plane perpendicular to a plane of the frontside, and the sub edge portion is arranged as a tongue between the first front edge portion and the insertion groove. The second edge portion has a second front edge portion configured to be in contact with the first front edge portion in the assembled state of the panels.

The second edge portion further has a second sub edge portion adapted to be positioned opposite the first sub edge portion in the assembled state, the second edge portion further having a protrusion arranged between the second sub edge portion and the backside of the panel.

The protrusion is configured to cooperate with the first sub edge portion during assembling of the opposite first and second edge portions. A first distance between a first plane of the first front edge portion perpendicular to the frontside of the first panel and a second plane parallel to said first plane and in line with a front edge of the first sub edge portion is equal to or larger than a second distance between a third plane of the second front edge portion perpendicular to the frontside of the second panel and a fourth plane parallel to said third plane and in line with a front edge of the protrusion of the second edge portion.

The panels, especially floor panels, have a shorter side and a longer side. Upon assembling the panels, the edge of a longer side of a panel is placed in a groove of another already positioned floor panel and the panel is slid in a lateral direction towards another already positioned panel on the shorter side of the panel. With the present set of panels, when the panel to be put into place is slid at an angle relative the other panels, the first contact is made by the protrusion of the second edge portion and the first sub edge portion of the first edge portion of the panel towards which the panel to be assembled is slid. Having the first contact between said portions allows for the panel to have a larger angle when sliding it into position and thus lowering the friction between the edge of the panel in the groove of the positioned panel. In other words, it is easier to assemble and at the same time avoiding any damages to the front surface edges/front edge portions.

According to another aspect of the present disclosure, the set of panels has a difference between the first distance and the second distance from 0 mm to about 0.5 mm.

According to a further aspect of the present disclosure the first distance is larger than the second distance, preferably from 0.01 mm to about 0.2 mm and more preferably about 0.1 mm.

According to yet another aspect of the present disclosure the flexible tongue on the first edge portion is arranged to cooperate with a tongue groove on the second edge portion for locking the first and second panels in the same plane. Thus, for a floor panel, this locks the panel and prevents movement in the vertical direction.

In accordance with one aspect of the present disclosure, the protrusion of the second edge portion is configured to cooperate with the first sub edge portion during assembly such that the first and second front edge portions are protected. That is, the first and second front edge portions are prevented from colliding during a majority of a process of folding down to its final and assembled position. This can prevent damage to the frontside or front surface of the panel adjacent the first and second front edge portions. The front edge portions are protected basically all the way until the panel being positioned is in its final place.

According to yet an aspect of the present disclosure, the first locking element is arranged on a locking strip of the first edge portion. Preferably, the locking strip protrudes beyond the first sub edge portion. Generally, one side of the strip constitutes a part of the backside of the panel such that the strip rests against the supporting surface.

In accordance with another aspect of the present disclosure, the first sub edge portion has a flat surface towards the second edge portion, the flat surface of the first sub edge portion configured to cooperate with the protrusion at an angled position of the second panel.

Thus, when pressing the panel to the plane locked position, the protrusion slides against the first sub edge portion smoothly.

In accordance with yet another aspect of the present disclosure, the second panel is at an angle of about 5° to about 60°, or about 45° in the angled position during a first step of assembly of the panels.

According to an alternative aspect of the present disclosure, the first sub edge portion is at an angle relative the second plane. This angle is preferably between 2 and 4 degrees and most preferably about 3 degrees. When the protrusion slides along the first sub edge portion, the angled surface facilitates the locking since the friction decreases the closer to the locked position the panel is upon assembly.

According to a further aspect of the present disclosure, the flexible tongue is spring loaded. An alternative would be to have the flexible tongue made of an elastic material, for instance, such as rubber.

The protrusion protrudes beyond the first sub edge portion in the assembled state of the panels according to an aspect of the present disclosure. In other words, the protrusion rests in a position in the assembled state beyond the first sub edge portion after being slid along the same during assembly.

According to yet one aspect of the present disclosure, the second front edge portion protrudes beyond the first sub edge portion in the assembled state of the panels. Thus, in the assembled state, the first sub edge portion is hidden, i.e., not ocularly detectable between the panels, should they be slightly separated.

The first sub edge portion protrudes beyond the first edge portion according to a further aspect of the present disclosure.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional objects, features, and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1A:
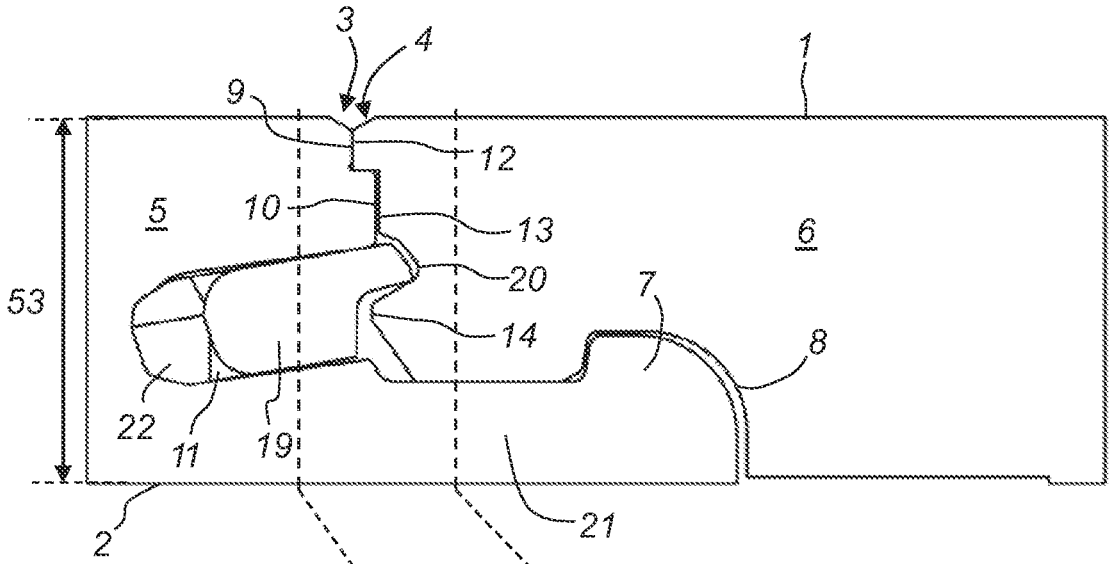
FIG. 1A is a partial sideview of a set of panels according to the present disclosure in assembled state.

Specific embodiments of the invention now will be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Figure 1B:
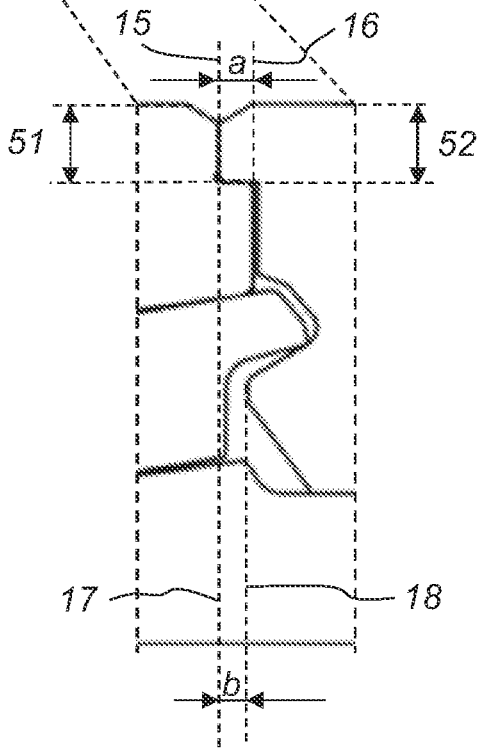
FIG. 1B is an enlarged portion of FIG. 1A.

With reference to FIG. 1A, a set of floor panels is disclosed in assembled state and FIG. 1B shows an enlarged portion of FIG. 1A. The set of rectangular building panels have a frontside 1 and a backside 2 and they comprise a mechanical locking device at opposite first and second edge portions 3, 4 configured for plane locking/horizontal locking of similar panels in an assembled position by means of displacement of a plane with a second edge portion 4 of a second panel 6 in an engagement direction towards a first edge portion 3 of an adjacent first panel 5.

The first edge portion 3 comprises a first locking element 7 configured to cooperate for plane locking with a first locking groove 8 at the second edge portion 4. The first edge portion 3 has a first front edge portion 9 adjacent the frontside 1 of the first panel 5 and a first sub edge portion 10 between the first front edge portion 9 and a flexible tongue 19 in an insertion groove 11, the insertion groove 11 being arranged between the backside 2 of the first panel 5 and the first sub edge portion 10.

The first front edge portion 9 provides a plane perpendicular to a plane of the frontside 1 and the sub edge portion 10 is arranged as a tongue between the first front edge portion 9 and the insertion groove 11. The second edge portion 4 has a second front edge portion 12 is in contact with the first front edge portion 9 in the assembled state of the panels, as shown in FIG. 1. The second edge portion 4 further has a second sub edge portion 13 positioned opposite the first sub edge portion 10 and the second edge portion 4 further has a protrusion 14 arranged between the second sub edge portion 13 and the backside 2 of the panel 6.

A surface of the first sub edge portions 10 and a surface of second sub edge portions 13 may be parallel.

The protrusion 14 is configured to cooperate with the first sub edge portion 10 during assembling of the opposite first and second edge portions 3, 4. A first distance a between a first plane 15 of the first front edge portion 9 perpendicular to the frontside 1 of the first panel 5 and a second plane 16 parallel to said first plane 15 and in line with a front edge of the first sub edge portion 10 is equal to or larger than a second distance b. The distance b being between a third plane 17 of the second front edge portion 12 perpendicular to the frontside 1 of the second panel 6 and a fourth plane 18 parallel to said third plane 17 and in line with a front edge of the protrusion 14 of the second edge portion 4. As further can be seen, the first locking element 7 is arranged on a locking strip 21 of the first edge portion 3 and the locking strip 21 protrudes beyond the first sub edge portion 10.

The figures show that the flexible tongue 19 is spring loaded. The spring 22 is only schematically shown in the figures.

As can further be seen, the protrusion 14 protrudes beyond the first sub edge portion 10 in the assembled state of the panels, see the enlarged part of the figure. Further, the second front edge portion 12 protrudes beyond the first sub edge portion 10 in the assembled state of the panels. Also, the first sub edge portion 10 protrudes beyond the first edge portion 9.

The first front edge 9 may comprise a depth 51 and the second front edge 12 may comprise a thickness 52. The benefit of the present disclosure may be greater when the thickness 52 is small. For instance, when the thickness 52 is less than 2 mm, such as 0.1 to 2 mm, less than 1 mm, such as 0.1 to 1 mm, and especially when the thickness 52 is less than 0.7 mm, such as 0.1 to 0.7 mm, the contact provided by the protrusion 14 to the first sub edge portion 10 may be prominent. The thinner the thickness 52 the more fragile the second front edge 12 may be and the more advantageous embodiments of the present disclosure may be.

The depth 51 may have the same dimensions as the thickness 52.

Figure 2A:
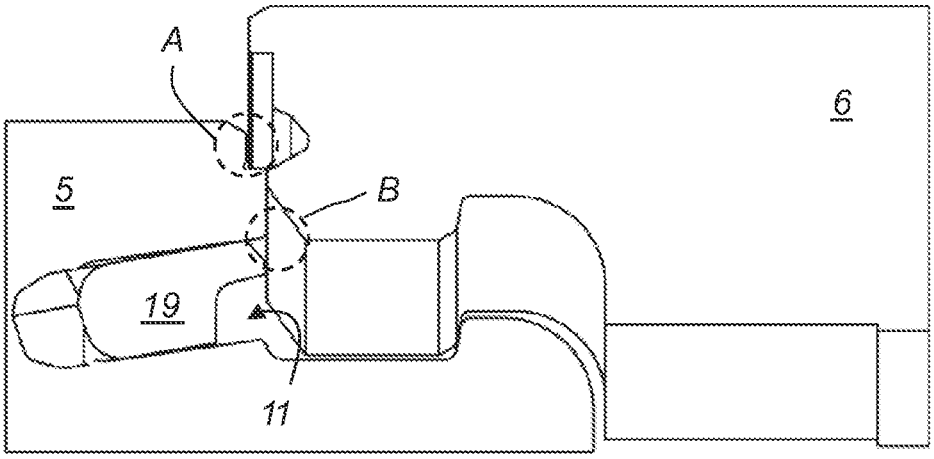
FIG. 2A shows a set of panels according to the present disclosure during assembling.
Figure 2B:
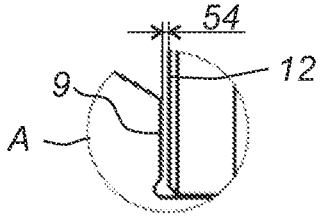
FIGS. 2B-2C show enlargements of portions of FIG. 2A.
Figure 2C:
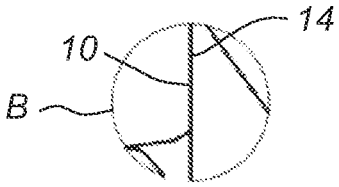

In FIG. 2A, the second panel 6 has been slid at an angle 56 against the first panel 5. The second panel 6 is at an angle of about 5° to about 60°, or about 45° in the angled position during a first step of assembly of the panels. The angle 56 may be measured as shown and described in relation to FIG. 7. The first contact between the first and second panels is made between the protrusion 14 and the first sub edge portion 10, see the enlarged part B in FIG. 2C. As can be seen in the enlarged part A in FIG. 2B, there is a distance 54 between the first front portion 9 and the second sub portion 12.

The protrusion 14 may push the flexible tongue 19 into the groove 11 of the first edge portion 3.

Figure 3A:
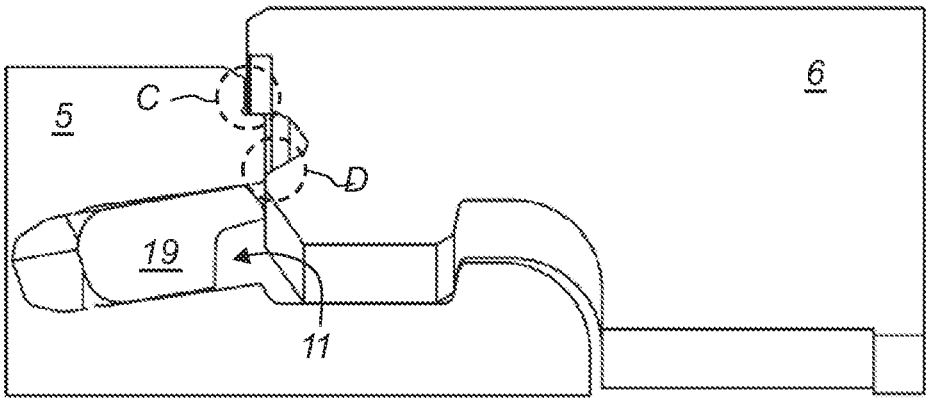
FIG. 3A shows the set of panels according to the present disclosure during assembling.
Figure 3B:
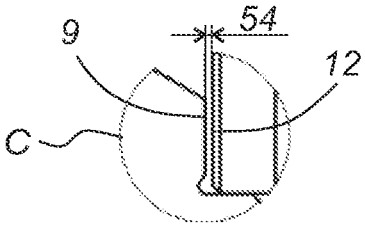
FIGS. 3B-3C show enlargements of portions of FIG. 3A.
Figure 3C:
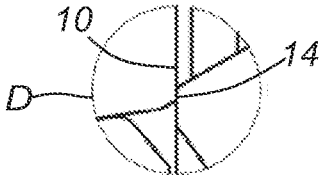

FIG. 3A, shows the second panel 6 closer to its final position in an assembled state. The enlarged part C in FIG. 3B shows that there is still a distance 54 between the first and second front edge portions 9, 12 since the contact is maintained between the protrusion 14 and the first sub edge portion 10 which is shown in the enlarged part D in FIG. 3C.

Figure 4A:
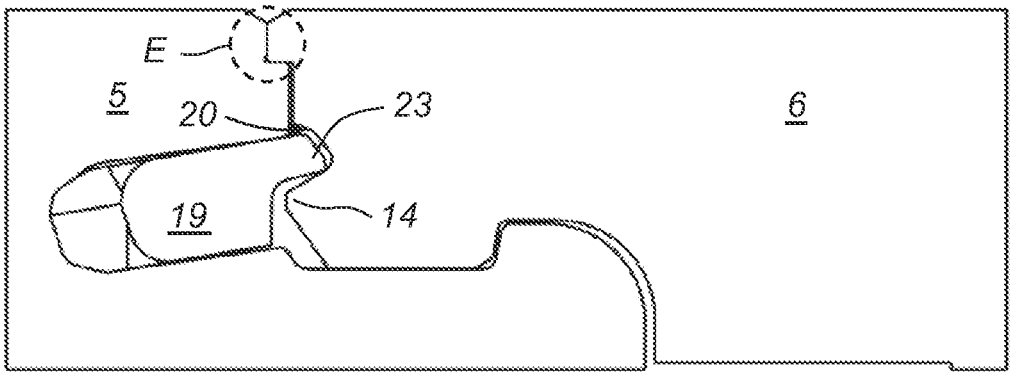
FIG. 4A shows the set of panels in an assembled state.

FIG. 4A shows the panels 5, 6 in an assembled state. The protrusion has passed a tip 23 of the flexible tongue 19 and the flexible tongue 19 is pressed outwards such that the tip 23 has protruded into a tongue groove 20 on the second edge portion 4. Thus, the flexible tongue 19 on the first edge portion 4 cooperates with the tongue groove 20 on the second edge portion 4 for locking the first and second panels 5, 6 in the same plane, i.e., in the case of floor panels they are locked vertically.

Figure 4B:
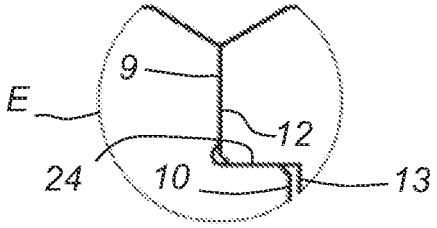
FIG. 4B shows an enlargement of a portion of FIG. 4A.

The enlarged part E in FIG. 4B shows that the first and second front edge portions 9, 12 are in contact. Also, the contact portion 24 between the two panels 5, 6 and between the first and second front edge portions 9, 12 and the first and second sub edge portions 10, 13 is in close contact, partly because of the cooperation between the flexible tongue 19 and the tongue groove 20 biasing the panels vertically together. The contact portion 24 may serve as seal, i.e., to exhibit some resistance to liquid passing through.

Figure 5A:
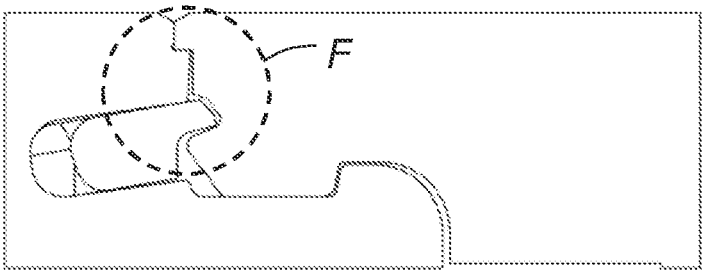
FIG. 5A shows an alternative embodiment of a set of panels according to the present disclosure.
Figure 5B:
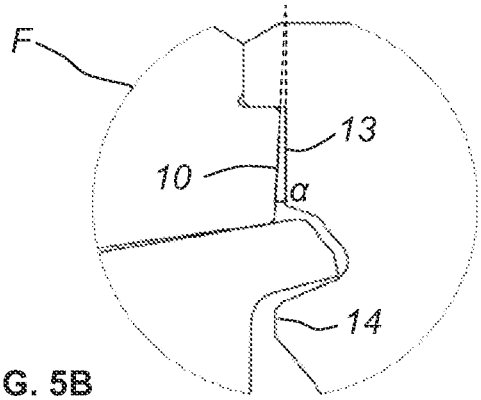
FIG. 5B shows an enlarged portion of FIG. 5A.

FIG. 5A shows an alternative embodiment of the first sub edge portion 10 and FIG. 5B shows an enlarged portion F of FIG. 5A. As can be seen the surface of the first and second sub edge portions 10, 13 are not parallel, rather the first sub edge portion 10 is angled making the distance between the sub edge portions 10, 13 larger the further towards the backside of the panels. The angle $\alpha$ could for instance be 1-20°, such as 1-10°, such as 1-5°, such as about 3°. A benefit with this solution is that the protrusion 14 of the second panel 6 more easily slides towards the assembled position since the friction between the two panels decreases the closer it comes to the final position.

Figure 6A:
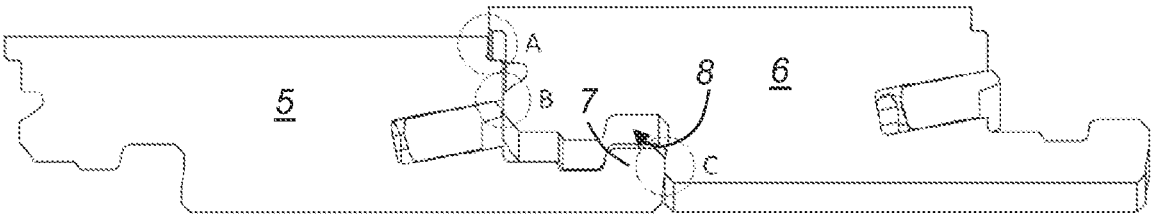
FIG. 6A shows a set of panels according to the present disclosure during assembling.
Figure 6B:
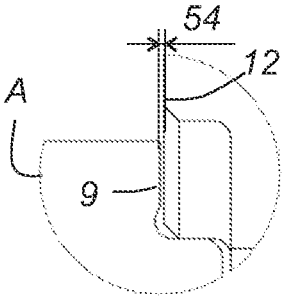
FIGS. 6B-6D show enlargements of portions of FIG. 6A.

FIG. 6A shows an embodiment of the first panel 5 and the second panel 6 during assembling. The enlarged part A in FIG. 6B shows a distance 54, however small, between the first and second front edge portions 9, 12. The enlarged part B in FIG. 6C shows that during assembly the protrusion 14 and the first sub edge portion 10 are in contact.

Figure 6D:
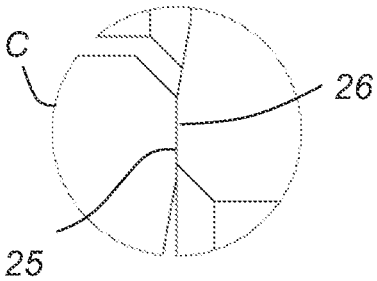
Figure 6C:
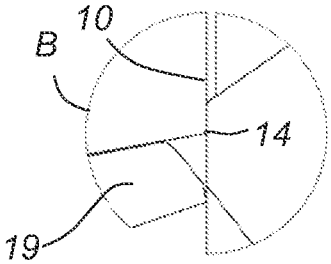

The enlarged part C in FIG. 6D shows that a front edge 25 of the first locking element 7 may cooperate with an edge 26 of the first locking groove 8. Thus, both the protrusion 14 and the first sub edge portion 10 together with the front edge 25 and the edge 26 may cooperate to provide a distance 54 between the first and second front edge portions 9, 12 during assembly.

Figure 6E:
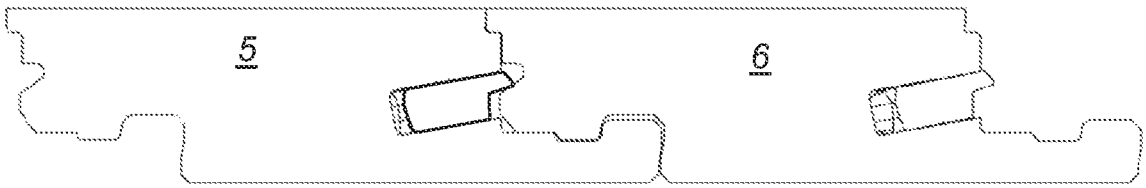
FIG. 6E shows the set of panels in FIG. 6A in an assembled state.

FIG. 6E shows the embodiment of the first panel 5 and the second panel 6 in an assembled state.

Figure 7:
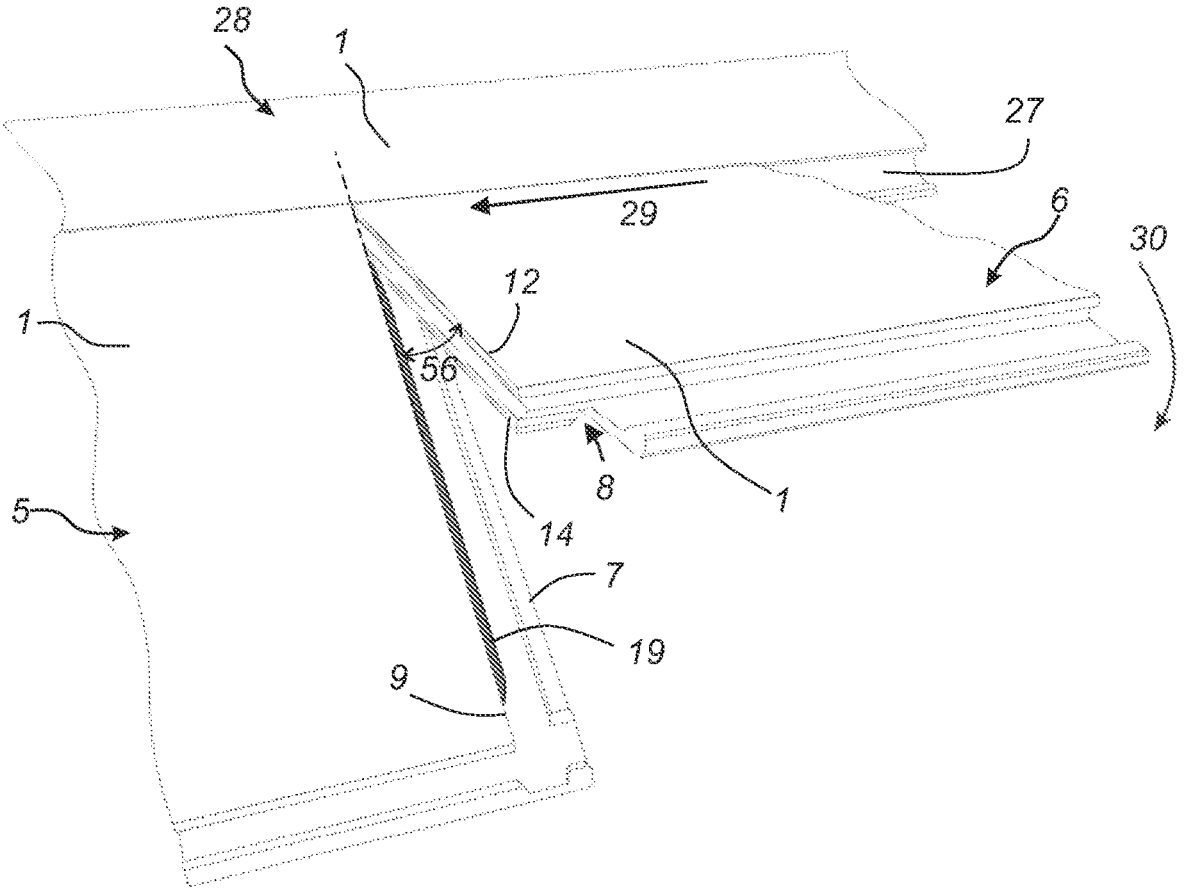
FIG. 7 is a perspective view of a set of panels during assembling.

FIG. 7 illustrate assembling of a second panel 6 to a first panel 5. The second panel 6 is fit into a groove 27 of a further panel 28 at an angle 56 of about 45°. The second panel 6 is then slid 29 towards the first panel 5 already in its final position. The protrusion 14 and the first sub edge portion 10, see for instance FIG. 1, cooperates to prevent the first and second front edge portions 9, 12 from colliding and thus damage the frontside or front surface of the panel adjacent the first and second front edge portions 9, 12. The assembling further comprises folding 30 the panel 6 down to its final and assembled position.

The first panel 5, the second panel 6 and the further panel 28 may each comprise a frontside 1.

The front side 1 of the first panel 5 and the front side 1 of the further panel 28 may be parallel during the folding.

The angle 56 may be measured between the frontside 1 of the first panel 5 and the frontside 1 of the second panel 6 or between the frontside 1 of the further panel 28 and the frontside of the second panel 6.

FIG. 8A to FIG. 10 show an embodiment of the first panel 5 and an embodiment of the second panel 6.

Figure 8A:
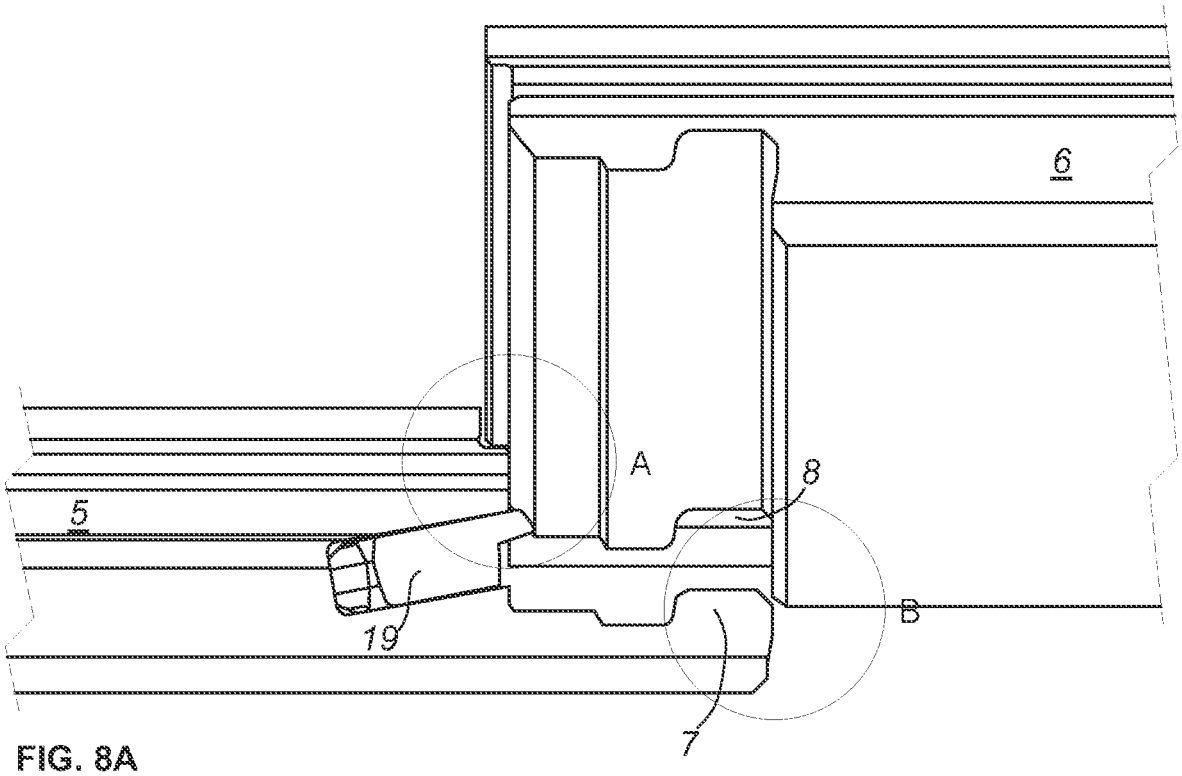
FIG. 8A shows a set of panels according to the present disclosure during assembling.
Figure 8B:
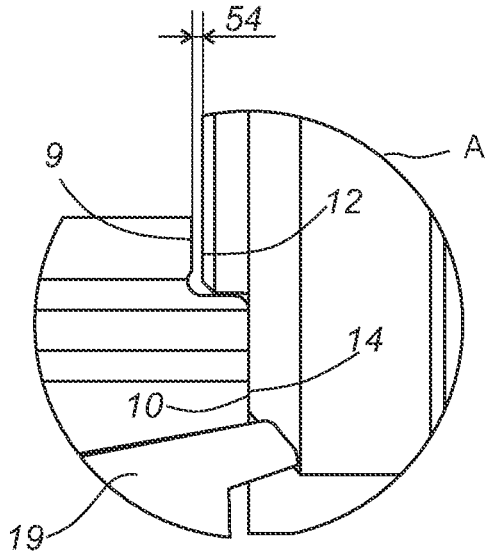
FIGS. 8B-8C show enlargements of portions of FIG. 8A.
Figure 8C:
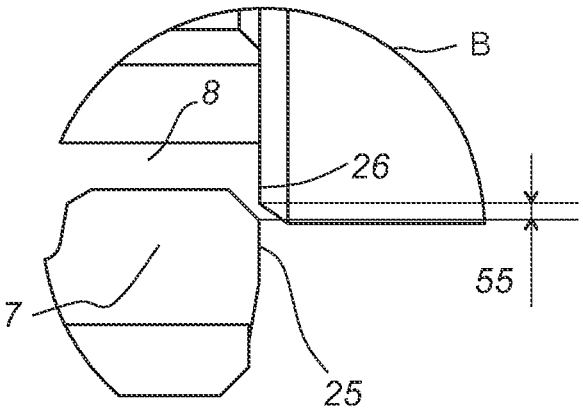

FIG. 8A shows the first panel 5 and the second panel 6 during an initial part of the assembling and FIGS. 8B-8C show enlargements of portions A and B, respectively, of FIG. 8A.

FIG. 8B shows that during the initial part of the assembling the protrusion 14 and the first sub edge portion 10 are configured to cooperate.

The first front portion 9 and the second sub portion 12 may be positioned at a distance 54 from each other. The distance 54 may be in the range of 0 mm to about 0.2 mm, such as 0.01 mm to 0.1 mm or about 0.05 mm.

The distance 54 may be measured by a feeler gauge.

FIG. 8C shows that during the initial part of the assembling the front edge 25 of the first locking element 7 and the edge 26 of the first locking groove 8 are configured to be spaced from each other. The size of the space 57 may depend on the angle 56 of the second panel 6, such that a lower angle 56 of the second panel 6 leads to a smaller size of the space 57.

Figure 9A:
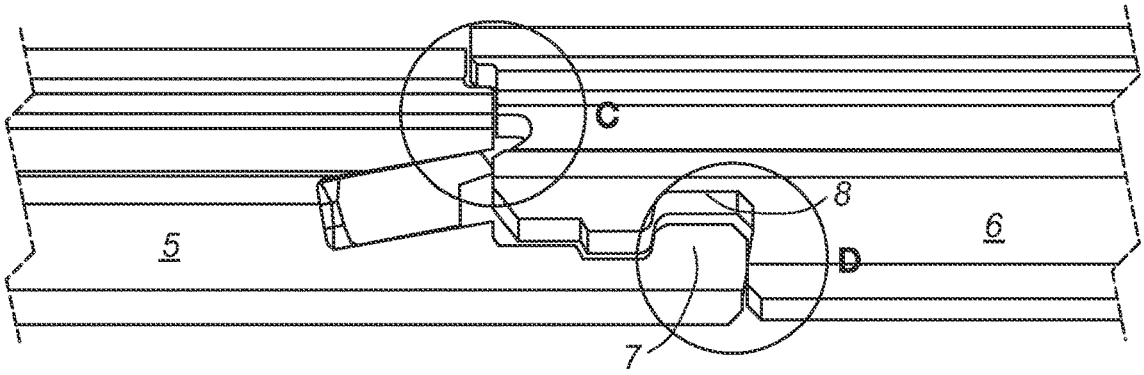
FIG. 9A shows a set of panels according to the present disclosure during assembling.
Figure 9B:
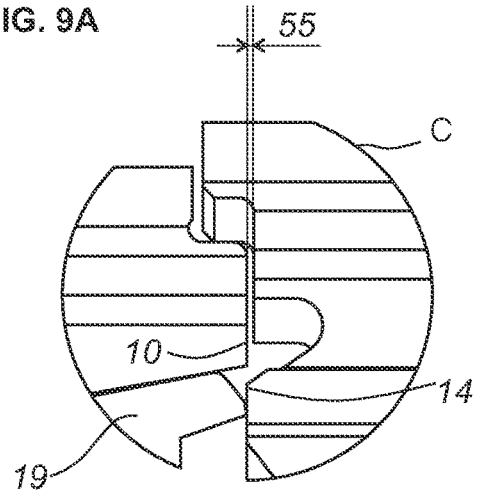
FIGS. 9B-9C show enlargements of portions of FIG. 9A.

FIG. 9A shows the first panel 5 and the second panel 6 during a subsequent part of the assembling and FIGS. 9B-8C show enlargements of portions C and D, respectively, of FIG. 9A.

FIG. 9B shows that during the subsequent part of the assembling the protrusion 14 and the first sub edge portion 10 are configured to be positioned at a distance 55 from each other.

During the subsequent part of the assembling the flexible tongue 19 may be configured to cooperate with the protrusion 14.

Figure 9C:
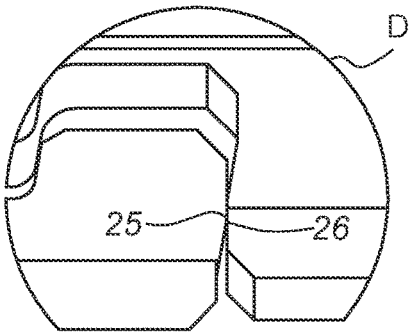

FIG. 9C shows that during the subsequent part of the assembling the front edge 25 of the first locking element 7 and the edge 26 of the first locking groove 8 are configured to cooperate.

Figure 10:
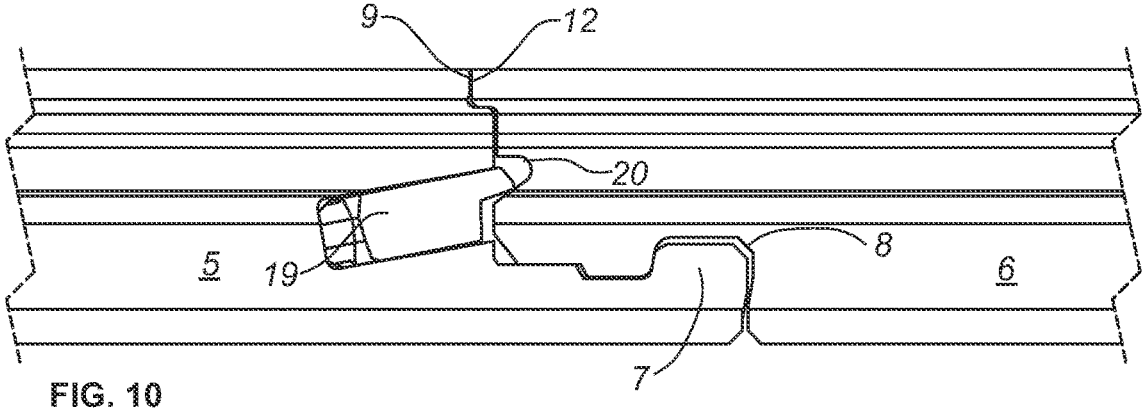
FIG. 10 shows the set of panels in FIG. 8A and FIG. 9A in an assembled state.

FIG. 10 shows the first panel 5 and the second panel 6 in an assembled position. The flexible tongue 19 at a first edge portion cooperates with the tongue groove 20 at a second edge portion for locking the first and second panels 5, 6 in the same plane, i.e., in the case of floor panels they are locked vertically.

The locking element 7 at the first edge portion cooperates with the locking groove 8 at the second edge portion for a plane locking/horizontal locking of the first panel 5 and second panel 6.

The locking element 7 may be configured to in the assembled position cooperate with the locking groove 8 such that the first edge portion is pushed towards the second edge portion, and/or that the distance between the first front portion 9 and the second sub portion 12 is reduced or is excluded.

Figure 11A:
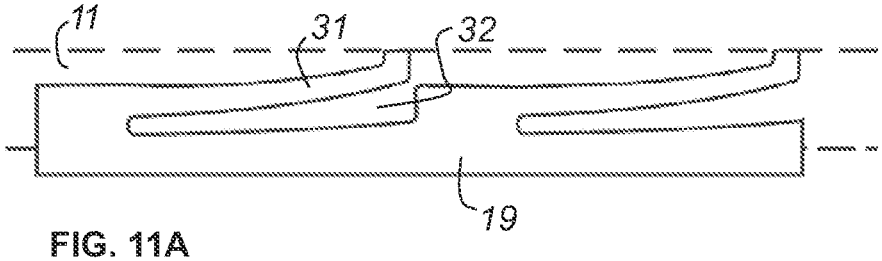
FIGS. 11A-11J show various embodiments of a flexible tongue according to the present disclosure.
Figure 11B:
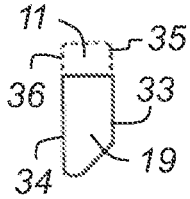
Figure 11C:
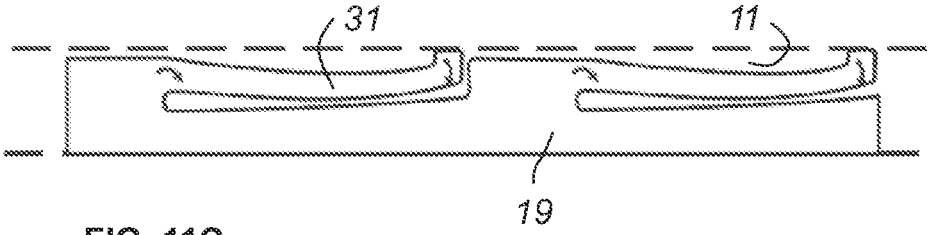
Figure 11D:
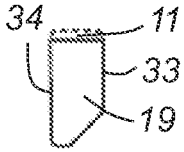

Embodiments of the flexible tongue 19, which is displaceable in the insertion groove 11, are shown in FIGS. 11A-11D. FIGS. 11A-11B show the flexible tongue 19 in a locked position and FIGS. 8C-8D show the flexible tongue 19 during assembling of the second panel 6. FIG. 11B shows a cross section of the flexible tongue 19 in FIG. 11Aa, which shows a top view. FIG. 11D shows a cross section of the flexible tongue 19 in FIG. 11C, which shows a top view. The flexible tongue 19 comprises bendable protruding parts 31. A space is provided between the flexible tongue 19 and a bottom wall of the insertion groove 11. FIG. 11C shows that the flexible tongue 19 is pushed into the insertion groove 11 and towards the bottom wall of the insertion groove 11 during an assembly of the second panel 6 with the first panel 5. The flexible tongue 19 springs back towards its initial position when the second panel 6 has reached a locked position relative the first panel 5. A recess 32 is preferably arranged at each bendable protruding part 31.

The flexible tongue 19 may have a first displacement surface 33 and an opposite second displacement surface 34, configured to be displaced along a third displacement surface 35 and a fourth displacement surface 36, respectively, of the insertion groove 11.

Figure 11E:
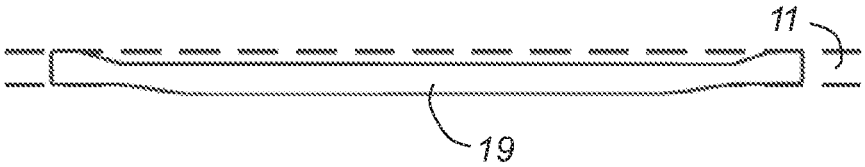
Figure 11F:
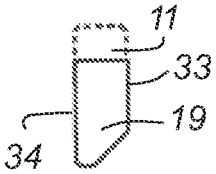

Another embodiment of the flexible tongue 19, without the protruding bendable parts 31, is shown in FIGS. 11E-11F. FIG. 11F shows a cross section of the flexible tongue 19 shown in FIG. 8E, which shows a top view. The alternative embodiment is bendable in the length direction of the flexible tongue 19 in order to accomplish a similar function as the embodiment shown in FIGS. 8A-8D.

Figure 11G:
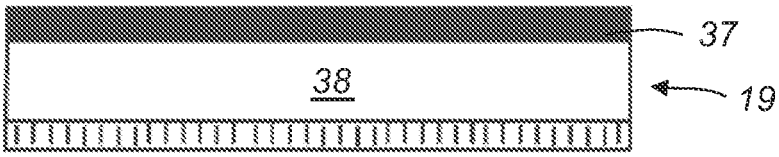

Another embodiment of the flexible tongue 19 is shown in FIG. 11G in a top view. The tongue 19 comprises an inner part 37 and an outer part 38. The inner part 37 and the outer part 38 are preferably made of two different materials, wherein the inner part 37 is more flexible than the outer part 38. The inner part 37 is configured to be inserted into the insertion groove 11 and the outer part 38 is configured to extend into the tongue groove 20 (see FIG. 1).

Figure 11H:
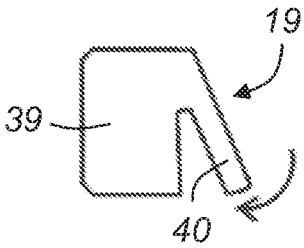
Figure 11I:
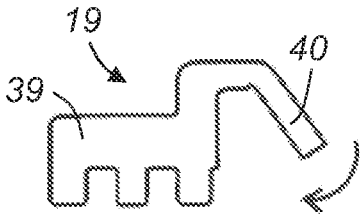
Figure 11J:
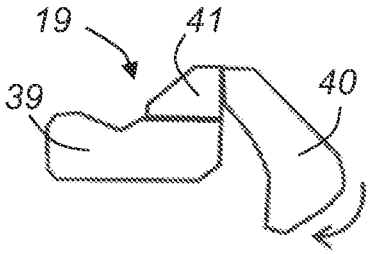

FIGS. 11G-11J show in cross section embodiments of the tongue 19 comprising an inner part 39 and a pivoting outer part 40. The inner part 39 is configured to be inserted into the insertion groove 11 and the outer part 40 is configured to extend into the tongue groove 20 and pivot during assembly of the second panel 6 with the first panel 5. The embodiments in FIGS. 11H-11I are preferably produced in one material, such as a polymer, by extruding. The embodiment in FIG. 11J is preferably produced by coextruding and comprises at least two different polymer materials. The embodiment comprises a hinge portion 41 which connects the inner part 39 and the outer part 40. The material of the hinge portion 41 is preferably more flexible than the inner part 39 and the outer part 40.

The panels may be floorboards, wall panels, ceiling panels, a furniture component, or the like.

A core of each of the building panels may be a wood-based core, such as comprising an HDF board, a particle board, or a plywood material.

A core of each of the building panels may be a polymer-based core, such as comprising a thermoplastic material, and preferably a filler, or a thermosetting material. For example, the thermoplastic material may comprise PVC and the thermosetting material may comprise a melamine formaldehyde resin.

A core of each of the building panels may be a mineral-based core, such as comprising magnesium oxide and, optionally, magnesium chloride, e.g., MgCl2, and/or magnesium sulphate, e.g., MgSO4.

The front face, such as an upper surface, of the panels is preferably provided with a decorative layer and the back face is preferably provided with a balancing layer.

The thickness 53 of the panels may be in the range of about 3 mm to about 10 mm, and preferably in the range of about 4 mm to about 8 mm.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teaching of the present invention is/are used.

The indefinite articles "a" and "an," as used herein in the specification and in the claims, unless clearly indicated to the contrary, should be understood to mean "at least one."

Embodiments

1. A set of rectangular building panels having a frontside 1 and a backside 2, comprising a mechanical locking device at opposite first and second edge portions 3, 4 configured for plane locking of similar panels in an assembled position by means of displacement of a plane with a second edge portion 4 of a second panel 6 in an engagement direction towards a first edge portion 3 of an adjacent first panel 5, wherein the first edge portion 3 comprises a first locking element 7 configured to cooperate for plane locking with a first locking groove 8 at the second edge portion 4, wherein the first edge portion 3 has a first front edge portion 9 adjacent the frontside 1 of the first panel 5 and a first sub edge portion 10 between the first front edge portion 9 and a flexible tongue 19 in an insertion groove 11, the insertion groove 11 being arranged between the backside 2 of the first panel 5 and the first sub edge portion 10, wherein the first front edge portion 9 provides a plane perpendicular to a plane of the frontside 1, and the sub edge portion 10 is arranged as a tongue between the first front edge portion 9 and the insertion groove 11, wherein the second edge portion 4 has a second front edge portion 12 configured to be in contact with the first front edge portion 9 in the assembled state of the panels, the second edge portion 4 further having a second sub edge portion 13 adapted to be positioned opposite the first sub edge portion 10 in the assembled state, the second edge portion 4 further having a protrusion 14 arranged between the second sub edge portion 13 and the backside 2 of the panel 6, wherein the protrusion 14 is configured to cooperate with the first sub edge portion 10 during assembling of the opposite first and second edge portions 3, 4, and that a first distance a between a first plane 15 of the first front edge portion 9 perpendicular to the frontside 1 of the first panel 5 and a second plane 16 parallel to said first plane 15 and in line with a front edge of the first sub edge portion 10 is equal to or larger than a second distance b between a third plane 17 of the second front edge portion 12 perpendicular to the frontside 1 of the second panel 6 and a fourth plane 18 parallel to said third plane 17 and in line with a front edge of the protrusion 14 of the second edge portion 4.

2. The set of panels according to embodiment 1, wherein the difference between the first distance a and the second distance b is from 0 mm to about 0.5 mm.

3. The set of panels according to any of the preceding embodiments, wherein the first distance a is larger than the second distance b.

4. The set of panels according to embodiment 3, wherein the difference between the first distance a and the second distance b is from 0.01 mm to about 0.2 mm and more preferably about 0.1 mm.

5. The set of panels according to any of the preceding embodiments, wherein the flexible tongue 19 on the first edge portion is arranged to cooperate with a tongue groove 20 on the second edge portion 4 for locking the first and second panels 5, 6 in the same plane.

6. The set of panels according to any of the preceding embodiments, wherein the protrusion 14 is configured to cooperate with the first sub edge portion 10 during assembly such that the first and second front edge portions 9, 12 are protected.

7. The set of panels according to any of the preceding embodiments, wherein the first locking element 7 is arranged on a locking strip 21 of the first edge portion 3.

8. The set of panels according to embodiment 7, wherein the locking strip 21 protrudes beyond the first sub edge portion 10.

9. The set of panels according to any of the preceding embodiments, wherein the first sub edge portion 10 has a flat surface towards the second edge portion 4, the flat surface of the first sub edge portion 10 configured to cooperate with the protrusion 14 at angled position of the second panel 6.

10. The set of panels according to embodiment 9, wherein the second panel 6 is at an angle of about 5° to about 60°, or about 45° in the angled position during a first step of assembly of the panels.

11. The set of panels according to any of the preceding embodiments, wherein the first sub edge portion 10 is at an angle relative the second plane 16.

12. The set of panels according to any of the preceding embodiments, wherein the flexible tongue 19 is spring loaded.

13. The set of panels according to any of the preceding embodiments, wherein the protrusion 14 protrudes beyond the first sub edge portion 10 in the assembled state of the panels.

14. The set of panels according to any of the preceding embodiments, wherein the second front edge portion 12 protrudes beyond the first sub edge portion 10 in the assembled state of the panels.

15. The set of panels according to any of the preceding embodiments, wherein the first sub edge portion 10 protrudes beyond the first edge portion 9.

16. The set of panels according to any of the preceding embodiments, wherein the flexible tongue 19 is configured to cooperate with the protrusion 14 during assembling.

17. The set of panels according to any of the preceding embodiments, wherein a tip 23 of the flexible tongue 19 is configured to cooperate with the protrusion 14 during assembling.

The invention claimed is:

1. A set of rectangular building panels having a frontside and a backside, comprising a mechanical locking device at opposite first and second edge portions configured for plane locking of similar panels in an assembled position by displacement of a plane with a second edge portion of a second panel in an engagement direction towards a first edge portion of an adjacent first panel, the plane locking including locking along a plane of the frontside, wherein the first edge portion comprises a first locking element configured to cooperate for plane locking with a first locking groove at the second edge portion, wherein the first edge portion has a first front edge portion adjacent the frontside of the first panel and a first sub edge portion between the first front edge portion and a flexible tongue in an insertion groove, the insertion groove being arranged between the backside of the first panel and the first sub edge portion, wherein the first front edge portion provides a plane perpendicular to the plane of the frontside, and the first sub edge portion is arranged as a tongue between the first front edge portion and the insertion groove, wherein the second edge portion has a second front edge portion configured to be in contact with the first front edge portion in the assembled state of the panels, the second edge portion further having a second sub edge portion configured to be positioned opposite the first sub edge portion in the assembled state, the second edge portion further having a protrusion arranged between the second sub edge portion and the backside of the panel, wherein the protrusion is configured to cooperate with the first sub edge portion during assembling of the opposite first and second edge portions, wherein a first distance between a first plane of the first front edge portion of the first panel and a second plane facing said first plane and in line with a front edge of the first sub edge portion is equal to or larger than a second distance between a third plane of the second front edge portion perpendicular to the frontside of the second panel and a fourth plane parallel to said third plane and in line with a front edge of the protrusion of the second edge portion, and wherein the flexible tongue is configured to cooperate with the protrusion during assembling.

2. The set of panels according to claim 1, wherein the difference between the first distance and the second distance is from 0 mm to about 0.5 mm.

3. The set of panels according to claim 1, wherein the first distance is larger than the second distance.

4. The set of panels according to claim 3, wherein the difference between the first distance and the second distance is from 0.01 mm to about 0.2 mm.

5. The set of panels according to claim 1, wherein the flexible tongue on the first edge portion is arranged to cooperate with a tongue groove on the second edge portion for locking the first and second panels in the same plane.

6. The set of panels according to claim 1, wherein the protrusion is configured to cooperate with the first sub edge portion during assembly such that the first and second front edge portions are protected, such that the first and second front edge portions are prevented from colliding during assembling.

7. The set of panels according to claim 1, wherein the first locking element is arranged on a locking strip of the first edge portion.

8. The set of panels according to claim 7, wherein the locking strip protrudes beyond the first sub edge portion.

9. The set of panels according to claim 1, wherein the first sub edge portion has a flat surface towards the second edge portion, the flat surface of the first sub edge portion configured to cooperate with the protrusion at angled position of the second panel.

10. The set of panels according to claim 9, wherein the second panel is configured to be at an angle of about 5° to about 60°, in the angled position during a first step of assembly of the panels.

11. The set of panels according to claim 1, wherein the first sub edge portion is at an angle relative the second plane, and wherein the angle is 1-20°.

12. The set of panels according to claim 1, wherein the flexible tongue is spring loaded.

13. The set of panels according to claim 1, wherein the protrusion protrudes beyond the first sub edge portion in the assembled state of the panels.

14. The set of panels according to claim 1, wherein the second front edge portion protrudes beyond the first sub edge portion in the assembled state of the panels.

15. The set of panels according to claim 1, wherein the first sub edge portion protrudes beyond the first edge portion.

16. The set of panels according to claim 1, wherein the first plane of the first front edge portion is perpendicular to the frontside of the first panel, and wherein the second plane is parallel to the first plane.

17. The set of panels according to claim 1, wherein the fourth plane at the front edge of the protrusion is between the first plane and the second plane.

18. The set of panels according to claim 1, wherein the first distance is equal to the second distance.

* * * * *